US010264817B2

(12) United States Patent
Haun

(10) Patent No.: US 10,264,817 B2
(45) Date of Patent: Apr. 23, 2019

(54) ESSENTIAL OIL VERTICAL VAPORIZER PIPE WITH REMOVABLE HEAT RESISTANT PROTECTIVE SLEEVE

(71) Applicant: Gregory Bryan Haun, Warren, OH (US)

(72) Inventor: Gregory Bryan Haun, Warren, OH (US)

( * ) Notice: Subject to any disclaimer, the term of this patent is extended or adjusted under 35 U.S.C. 154(b) by 0 days.

(21) Appl. No.: 15/420,978

(22) Filed: Jan. 31, 2017

(65) Prior Publication Data

US 2017/0258129 A1 Sep. 14, 2017

Related U.S. Application Data

(60) Provisional application No. 62/305,184, filed on Mar. 8, 2016.

(51) Int. Cl.

| | |
|---|---|
| ***A24F 11/00*** | (2006.01) |
| ***A24F 47/00*** | (2006.01) |
| ***A24F 9/16*** | (2006.01) |

(52) U.S. Cl.

CPC ..... *A24F 9/16* (2013.01); *A24F 47/002* (2013.01); *A24F 47/006* (2013.01)

(58) Field of Classification Search

CPC ..... A24F 415/00–415/20; A24F 9/16; A24F 47/006

USPC ..... 131/329, 328

See application file for complete search history.

(56) References Cited

U.S. PATENT DOCUMENTS

| | | | | |
|---|---|---|---|---|
| 3,916,916 | A * | 11/1975 | Bramucci | A24F 13/16 131/175 |
| 4,913,169 | A * | 4/1990 | Templeton | A24B 15/16 131/194 |
| 5,388,594 | A * | 2/1995 | Counts | A24F 47/008 128/202.21 |
| 5,666,978 | A * | 9/1997 | Counts | A24F 47/008 131/194 |
| 2011/0120482 | A1* | 5/2011 | Brenneise | A24F 47/008 131/328 |
| 2011/0277779 | A1* | 11/2011 | Hastings | A24F 13/18 131/257 |
| 2013/0087160 | A1* | 4/2013 | Gherghe | A24F 1/00 131/329 |
| 2015/0076014 | A1* | 3/2015 | Kesten | A24F 15/12 206/261 |
| 2016/0021929 | A1* | 1/2016 | Sawalha | A24F 47/002 131/329 |
| 2017/0008683 | A1* | 1/2017 | Fath | B65D 75/367 |

* cited by examiner

*Primary Examiner* — Abdullah A Riyami
*Assistant Examiner* — Thang H Nguyen
(74) *Attorney, Agent, or Firm* — John J. Elnitski, Jr.

(57) ABSTRACT

An essential oil vertical vaporizer pipe with a heat resistant removable protective sleeve that provides protection from the hot tip after the pipe is used. The vaporizer pipe has a built in heat resistant removable protective sleeve that can be slid back over the hot tip after each use to protect the user and the user's surroundings.

11 Claims, 3 Drawing Sheets

FIG.5
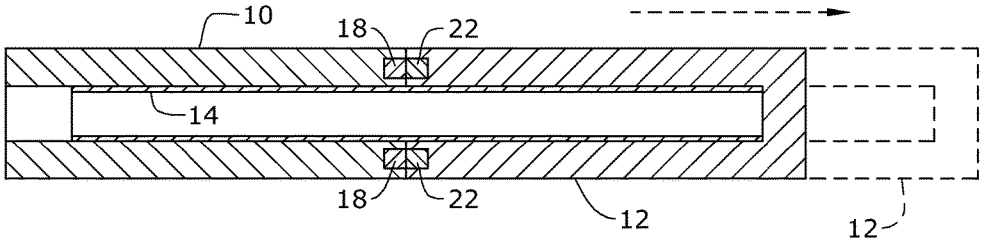
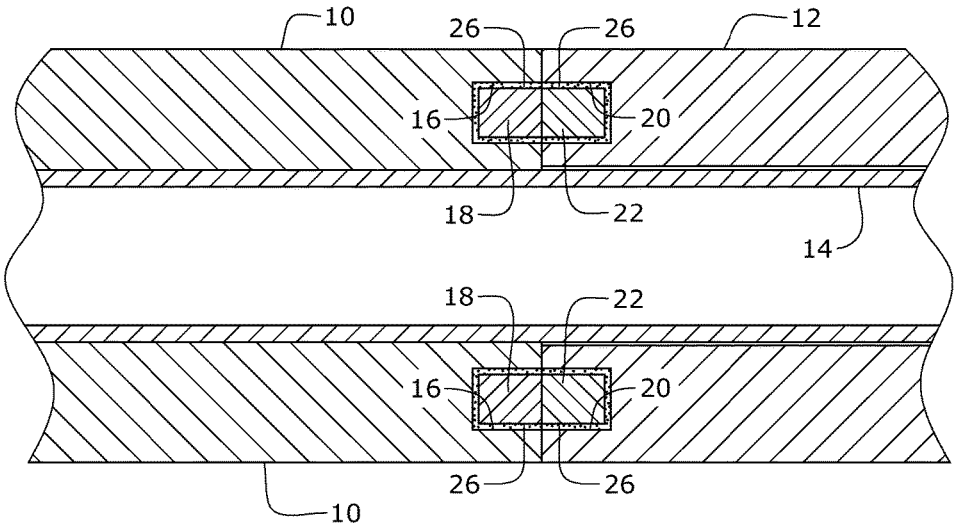
FIG.6

ESSENTIAL OIL VERTICAL VAPORIZER PIPE WITH REMOVABLE HEAT RESISTANT PROTECTIVE SLEEVE

CROSS-REFERENCE TO RELATED APPLICATION

This application claims the benefit of priority of U.S. provisional application No. 62/305,184, filed Mar. 8, 2016. the contents of which are herein incorporated by reference.

BACKGROUND OF THE INVENTION

The present invention relates to vaporizer pipes and, more particularly, to vaporizer pipes for use with essential oils.

With other essential oil vertical vaporizer pipes the operator has to handle them carefully after each use due to the tip of the pipe needing to cool down.

Other vertical vaporizer pipes have to be handled cautiously after each use because the tip will still be hot enough to harm the user or the user's surroundings.

As can be seen, there is a need for an improved vaporizer pipe with a built in heat resistant removable protective sleeve that can be slid back over the hot tip after each use to protect the user and the user's surroundings.

SUMMARY OF THE INVENTION

In one aspect of the present invention, a vaporizer pipe for essential oils, includes a mouthpiece formed of an elongate tube of thermally resistant material and an interior channel extending between a first end and a second end. A vaporizer tube formed of a length of thermally conductive material is received in the interior channel and extends from the first end of the mouthpiece. A protective sleeve may be formed of an elongate tube of thermally resistant material and has an interior cavity extending through a portion of the protective sleeve. The protective sleeve is removably coupled to the vaporizer pipe and is operable between a protective position of attachment to the vaporizer pipe by receiving a free end of the vaporizer tube and an operating position in which the protective sleeve is detached from the vaporizer pipe.

In some embodiments, the vaporizer pipe has a retainer for removably holding the protective sleeve in the protective position. The retainer may be formed by an interference fit between a portion of the free end of the vaporizer tube and the inner channel extending through the protective sleeve. In other embodiments, the retainer may include a mating surface defined on the first end of the mouthpiece and a cooperating mating surface defined at an end of the protective sleeve. The retainer may also include a slot defined in the mating surface and a magnetically attractive element carried in the slot. In other embodiments, the retainer may also include a cooperating slot defined in the cooperating mating surface and a magnetically attractive element carried in the cooperating slot.

In other aspect of the invention a vaporizer pipe for an essential oil, has a mouthpiece formed of a thermally resistant material having an inner channel extending between a first end and a second end. A vaporizer tube is formed of a thermally conductive material and is received in the interior channel and extending from the first end of the mouthpiece. The vaporizer tube has a free end configured to receive a predetermined quantity of the essential oil. A protective sleeve that formed of a thermally resistant material has an interior cavity extending through a portion of the protective sleeve corresponding to a length of the free end of the vaporizer tube. The protective sleeve is removably coupled to the vaporizer pipe and is operable between a protective position covering the vaporizer tube and an operating position in which the free end of the vaporizer tube is removed from the protective sleeve.

In some embodiments, the vaporizer pipe may have a mating surface defined on the first end of the mouthpiece and a cooperating mating surface defined at an end of the protective sleeve. A magnetic element may be coupled to the mating surface and a cooperating magnetic element is coupled to the cooperating mating surface. The mating surface and the cooperating mating surface may have a slot defined therein configured to receive the cooperating magnetic element therein.

These and other features, aspects and advantages of the present invention will become better understood with reference to the following drawings, description and claims.

BRIEF DESCRIPTION OF THE DRAWINGS

FIG. 5 is a section view illustrating the movement of 12.

FIG. 6 is an enlarged section view showing a mating surface and a cooperating mating surface.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved vaporizer pipe for use with essential oils. The vaporizer pipe includes a removable protective sleeve to permit rapid handling and transportability of the pipe after use.

Figure 1:
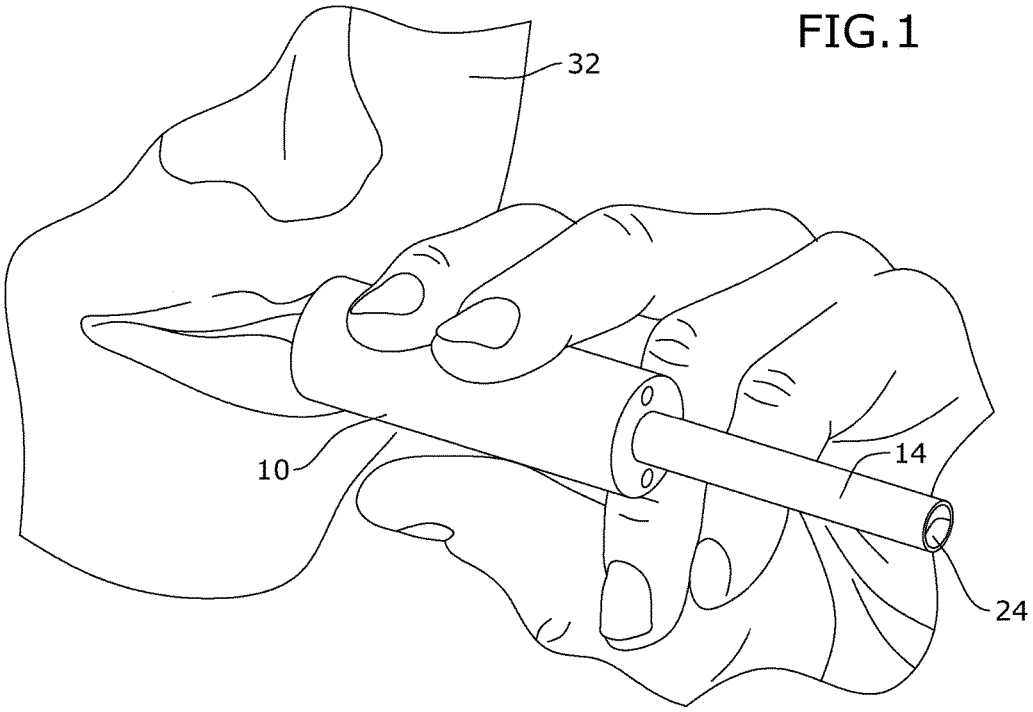
FIG. 1 is a perspective view of an embodiment of the vaporizer pipe shown in use.

As seen in reference to FIG. 1, an embodiment of a vaporizer pipe of the present invention is shown in use by a user 32. The vaporizer pipe includes a mouthpiece 10 and an elongate vaporizer tube 14 having a free end that is extends from a first end of the mouthpiece 10. A second end of the mouthpiece 10 is held in position next to the lips of the user 32.

Figure 4:
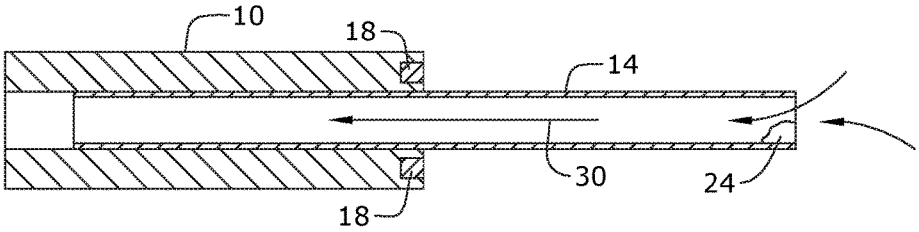
FIG. 4 is a section view of the invention taken from 4-4 in FIG. 1.

The vaporizer tube 14 is formed from a thermally conductive material, such as metal, glass, or ceramic. In typical use, a heat source, such as a match, lighter, or the like is applied to a tip of the free end of the vaporizer tube 14 so as to vaporize the essential oil 24 when contacted by the heated tip of the vaporizer tube 14. The user 32 would then draw a breath through the vaporizer tube 14 via the mouthpiece 10, thereby drawing in the essential oil vapors 30 with their breath, as shown in reference to FIG. 4.

As will be appreciated, the vaporizer tube 14 will become extremely hot during use and will remain hot for a time after such use. Accordingly, the mouthpiece 10 is formed of a thermally insulating material so as to protect the user's lips during use. A preferred material is wood, which has good insulating properties and provides a natural look to the pipe.

An interior channel is defined between the first end and the second end of the mouthpiece 10. As further shown in reference to FIG. 4, the end of the vaporizer tube 14 is offset from an opening in the second end of the mouthpiece 10 so as to keep the heat of the vaporizer tube 14 offset from the user's lips.

Figure 2:
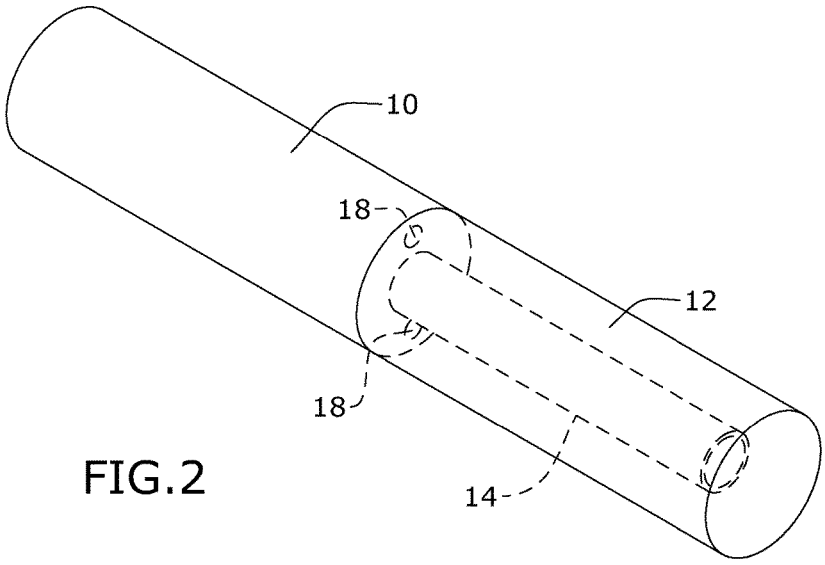
FIG. 2 is a perspective view of the vaporizer pipe.

As seen in reference to FIG. 2, the vaporizer pipe is provided with a protective sleeve 12 that has an interior cavity that is dimensioned to receive the free end of the vaporizer tube 14 within the cavity. The protective sleeve 12 may be configured with an interference fit with interior cavity and the free end of the vaporizer tube 14. The protective sleeve 12 is also formed from a thermally insulating material, which may be immediately applied to the vaporizer tube 14 after use to permit the vaporizer pipe to be readily handled or carried, such as by placing it in a user's pocket, bag, or carried in the user's hand.

Figure 3:
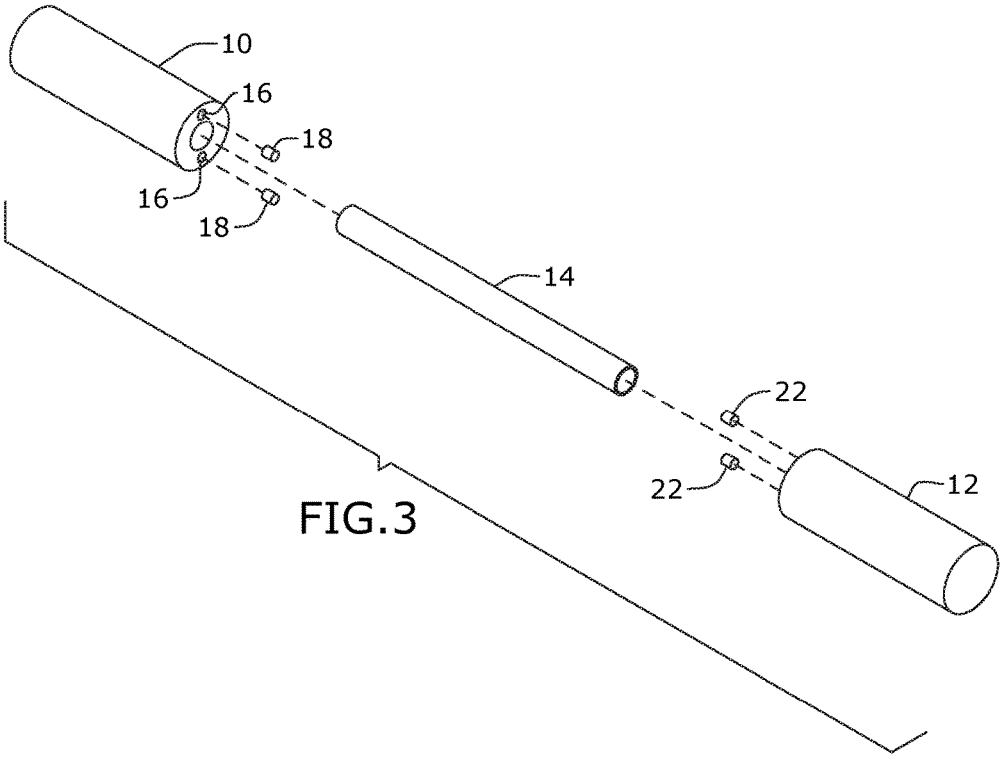
FIG. 3 is an exploded view of the vaporizer pipe.

As seen in reference to FIGS. 3, 5 and 6, the mouthpiece 10 and protective sleeve 12 each have a cooperating mating surface so that the ends thereof may be joined. The cooperating mating surfaces may be configured to releasably retain the protective sleeve 12 in attachment to the vaporizer pipe. The mating surface of the mouthpiece 10 has one or more slots 16 configured to receive a magnetically attractive element 18. Similarly, the cooperating mating surface of the protective sleeve 12 has one or more slots 20, which are also configured to receive a cooperating magnetically attractive element 22. The magnetically attractive elements 18 and 22, may each be magnets with attracted polarities or one may be a magnet while the other is formed of a ferrous material that is attracted to the magnet. The magnetically attractive elements 18 and 22, are each held into their corresponding slots 16 and 20, by use of an adhesive 26.

It should be understood, of course, that the foregoing relates to exemplary embodiments of the invention and that modifications may be made without departing from the spirit and scope of the invention as set forth in the following claims.

What is claimed is:

1. A vaporizer pipe for essential oils, comprising:

a mouthpiece having a first end and a second end, the mouthpiece is formed of a thermally resistant material, the mouthpiece including an interior channel extending between the first end and the second end of the mouthpiece and open at each of the first end and the second end of the mouthpiece;

a vaporizer tube received in the interior channel of the mouth piece and extending outward from the first end of the mouthpiece, the vaporizer tube is an elongate tube formed of thermally conductive material and is open at both ends of the tube, the vaporizer tube having one of the open ends as a free end that is extended away from the first end of the mouthpiece, the free end of the vaporizer tube adapted to be heated and adapted to receive an essential oil to be vaporized when the free end is heated; and a protective sleeve, the protective sleeve is a thermally resistant material, the protective sleeve includes an interior cavity extending through a portion of the protective sleeve to fit over and receive a length of vaporizer tube internally starting at the free end and cover the free end of the vaporizer tube, the protective sleeve is removably coupled to the vaporizer pipe so the protective sleeve is retained over the free end of the vaporizer tube during nonuse to provide protection from the vaporizer tube when the vaporizer tube is hot and is removable from the vaporizer tube when the vaporizer pipe is to be used.

2. The vaporizer pipe of claim 1, further comprising a retainer for removably holding the protective sleeve in the protective position over the free end of the vaporizer tube.

3. The vaporizer pipe of claim 2, wherein the retainer comprises an interference fit between a portion of the free end of the vaporizer tube and the interior cavity of the protective sleeve.

4. The vaporizer pipe of claim 2, wherein the retainer further comprises: a first mating surface defined on the first end of the mouthpiece; and a cooperating second mating surface defined at an end of the protective sleeve nearest the first end of the mouthpiece.

5. The vaporizer pipe of claim 4, wherein the retainer further comprises: a first slot defined in one of the first and second mating surfaces and a magnetic element in the first slot.

6. The vaporizer pipe of claim 5, wherein the retainer further comprises: a second slot defined in the other of the first and second mating surfaces that receives a cooperating magnetic element in the second slot.

7. A vaporizer pipe for an essential oil, comprising:

a mouthpiece having a first end and a second end, the mouthpiece formed of a thermally resistant material having an inner channel extending between a first end and a second end;

a vaporizer tube formed of a thermally conductive material received in the interior channel mouthpiece and having a free end extending from the first end of the mouthpiece;

a protective sleeve formed of a thermally resistant material, the protective sleeve having an interior cavity extending through a portion of the protective sleeve corresponding to a length of the free end of the vaporizer tube so that the protective sleeve covers the free end of the vaporizer tube, the protective sleeve is removably coupled to the vaporizer pipe and is operable between a protective position and an operating position in which the protective sleeve is removed from free end of the vaporizer tube.

8. The vaporizer pipe of claim 7, further comprising: a mating surface defined on the first end of the mouthpiece; and a cooperating mating surface defined at an end of the protective sleeve.

9. The vaporizer pipe of claim 8, further comprising: a magnetic element coupled to the mating surface; and a cooperating magnetic element coupled to the cooperating mating surface.

10. The vaporizer pipe of claim 9, further comprising: a slot defined in the mating surface configured to receive the magnetic element therein.

11. The vaporizer pipe of claim 10, further comprising: a slot defined in the cooperating mating surface configured to receive the cooperating magnetic element therein.

* * * * *